US007551420B2

(12) United States Patent
Cerqueira et al.

(10) Patent No.: US 7,551,420 B2
(45) Date of Patent: Jun. 23, 2009

(54) RETRACTABLE IGNITER

(75) Inventors: Emanoel De Oliveira Cerqueira, Salvador (BR); Edson Lino Dos Santos, Salvador (BR)

(73) Assignee: Petroleo Brasileiro S.A. - Petrobras, Rio de Janeiro (BR)

( * ) Notice: Subject to any disclaimer, the term of this patent is extended or adjusted under 35 U.S.C. 154(b) by 364 days.

(21) Appl. No.: 11/448,978

(22) Filed: Jun. 8, 2006

(65) Prior Publication Data

US 2006/0279900 A1 Dec. 14, 2006

(30) Foreign Application Priority Data

Jun. 9, 2005 (BR) ..... 0502266

(51) Int. Cl.
*F23Q 5/00* (2006.01)

(52) U.S. Cl. ..... 361/253; 361/262

(58) Field of Classification Search ..... 361/523, 361/260, 262, 263, 253
See application file for complete search history.

(56) References Cited

U.S. PATENT DOCUMENTS 4,110,667 A * 8/1978 Graf Vom Hagen ..... 313/143
4,397,273 A * 8/1983 Folkerts ..... 123/145 A

* cited by examiner

*Primary Examiner*—Danny Nguyen
(74) *Attorney, Agent, or Firm*—Nixon & Vanderhye, PC

(57) ABSTRACT

A retractable igniter having a safety mechanism to retract the source of ignition during an inactive period, avoiding unnecessary contact with said source of ignition is described, such igniter comprises: an ignition chamber, an electrode, an electrical high voltage assembly, an external pipe, an internal pipe and an activation lever.

6 Claims, 4 Drawing Sheets

RETRACTABLE IGNITER

FIELD OF THE INVENTION

The invention refers to an electric igniter having a safety mechanism to retract the source of ignition during an inactive period, avoiding unnecessary contact of said source with the gas.

The invention is useful to ensure the safety of ignition systems in industrial furnaces and to protect the integrity of the electrical components of the igniter, preserving it from incrustations and corrosion and thus providing a longer useful life.

BACKGROUND INFORMATION

Ignition systems are continually exposed to damaging environmental conditions during the time of operation, such as high temperatures, high humidity, incrustations and corrosion from different types of combustibles used, etc.

These conditions are aggravated when the igniter works within industrial oil burning furnaces. Exposure of electrical components of the igniter to the environment inside such furnaces may cause damages, such as incrustations and corrosion, which in turn causes ignition delays and a shortening of the useful life of said components.

Thus, a technique is needed to provide an electrical igniter, with a safety mechanism that allows the source of ignition to be retracted during the period of inactivity, avoiding unnecessary contact of said source of ignition with the environment inside the furnace.

The igniter described in this invention provides safety in industrial furnaces and protects the integrity of the electrical components of the igniter.

SUMMARY OF THE INVENTION

Broadly, this invention relates to a retractable igniter including a mechanism to protect the source of ignition.

This invention applies to industrial furnaces using gas or liquid combustibles, in spark plug igniters for motors and internal combustion automotive motors which uses gas or liquid combustible or both.

This invention provides means to isolate electrical components of the igniter, safeguarding them from critical factors such as: humidity, high temperatures, incrustations and corrosion, providing a prolongation of their useful life.

BRIEF DESCRIPTION OF THE DRAWINGS

FIG. 1A illustrates the front view of the igniter in a retractable position and FIG. 1B illustrated the igniter in the exposed position of the ignition source.

FIG. 3A illustrates the inner view of the igniter in a retractable position while FIG. 3B shows the igniter in the exposed position.

DETAILED DESCRIPTION OF THE INVENTION

Figure 1:
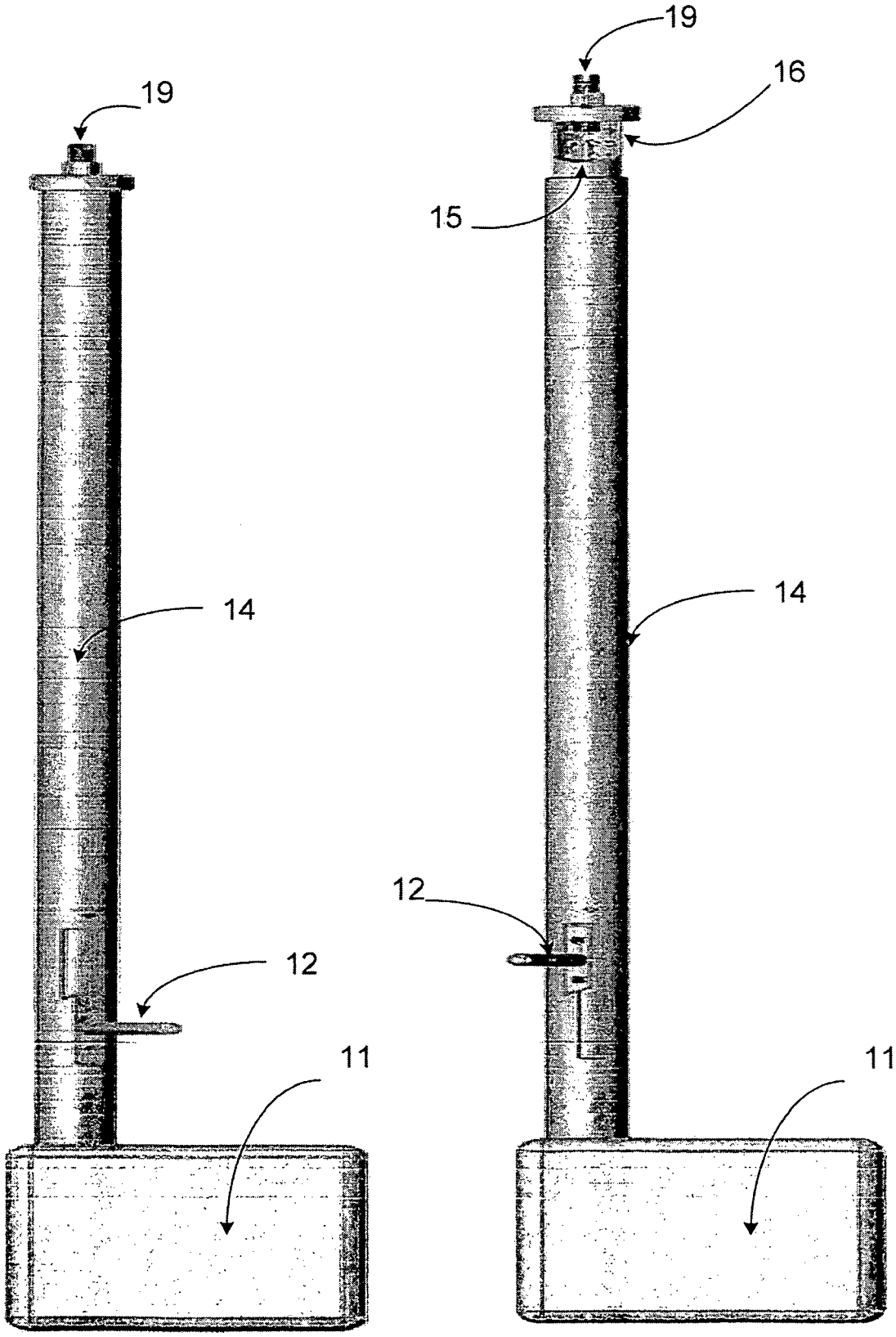
FIG. 1 illustrates the outside view of the igniter of the present invention.
Figure 2:
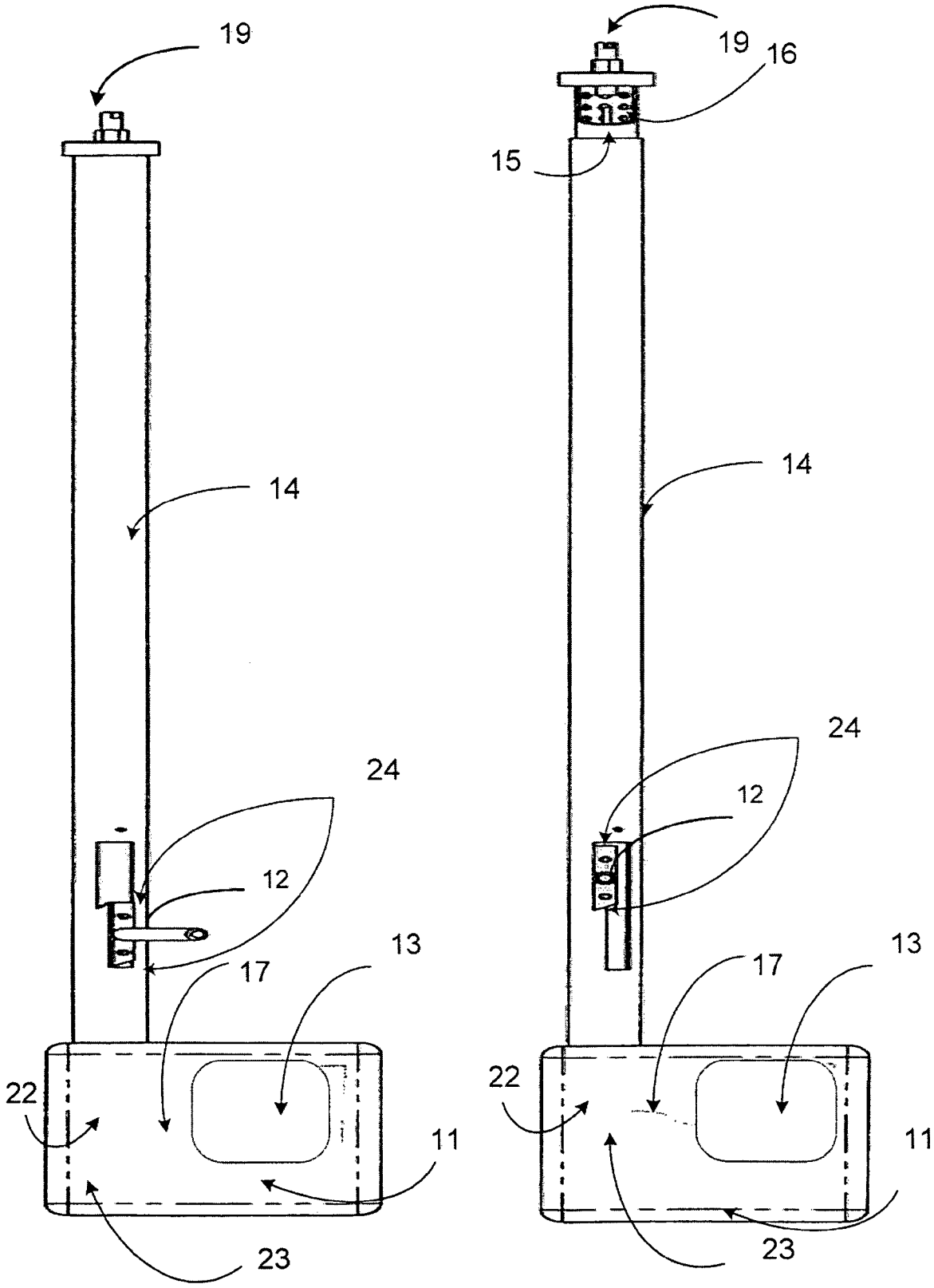
FIG. 2—presents the igniter including the high voltage assembly.
Figure 3:
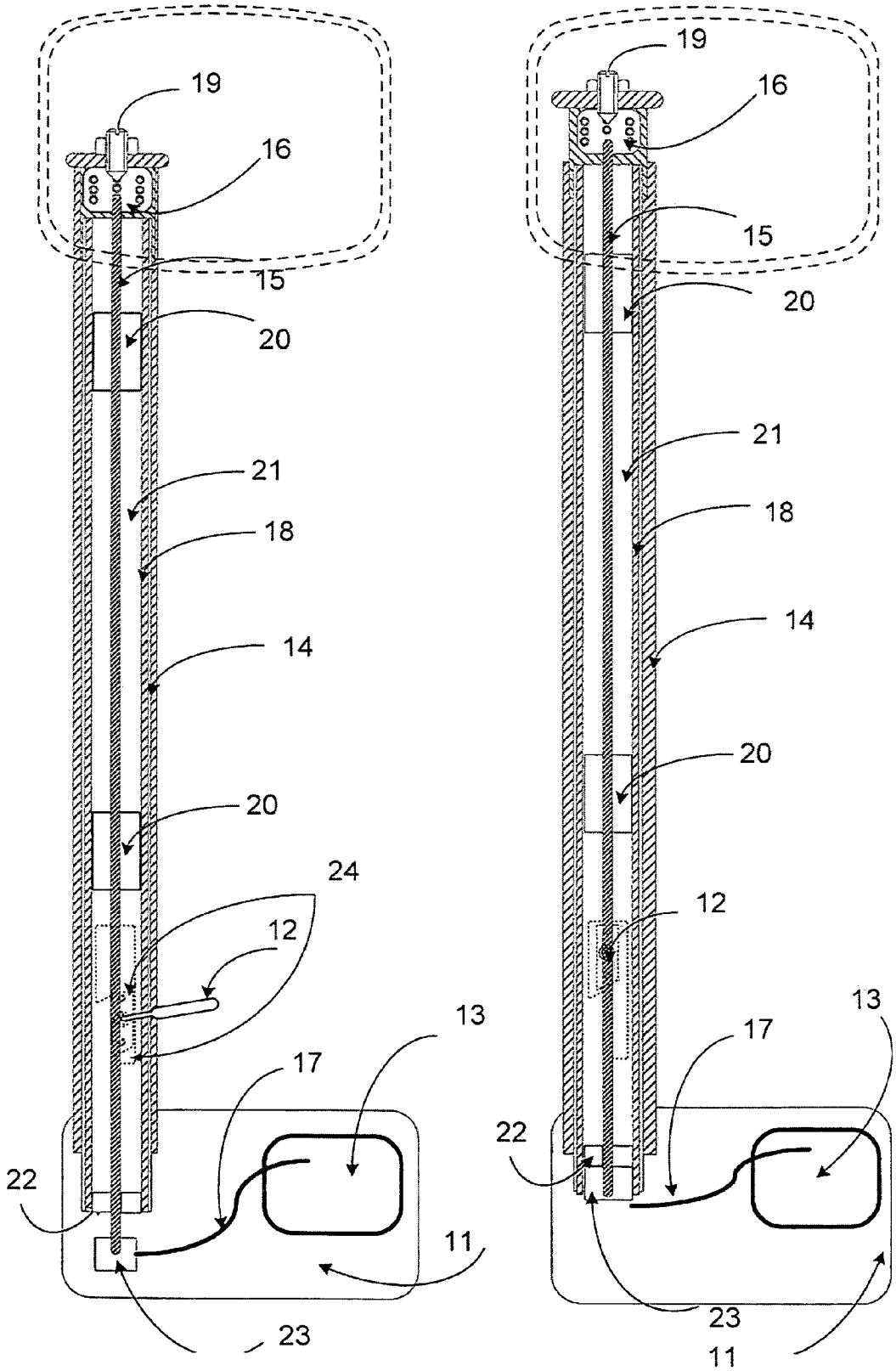
Figure 4:
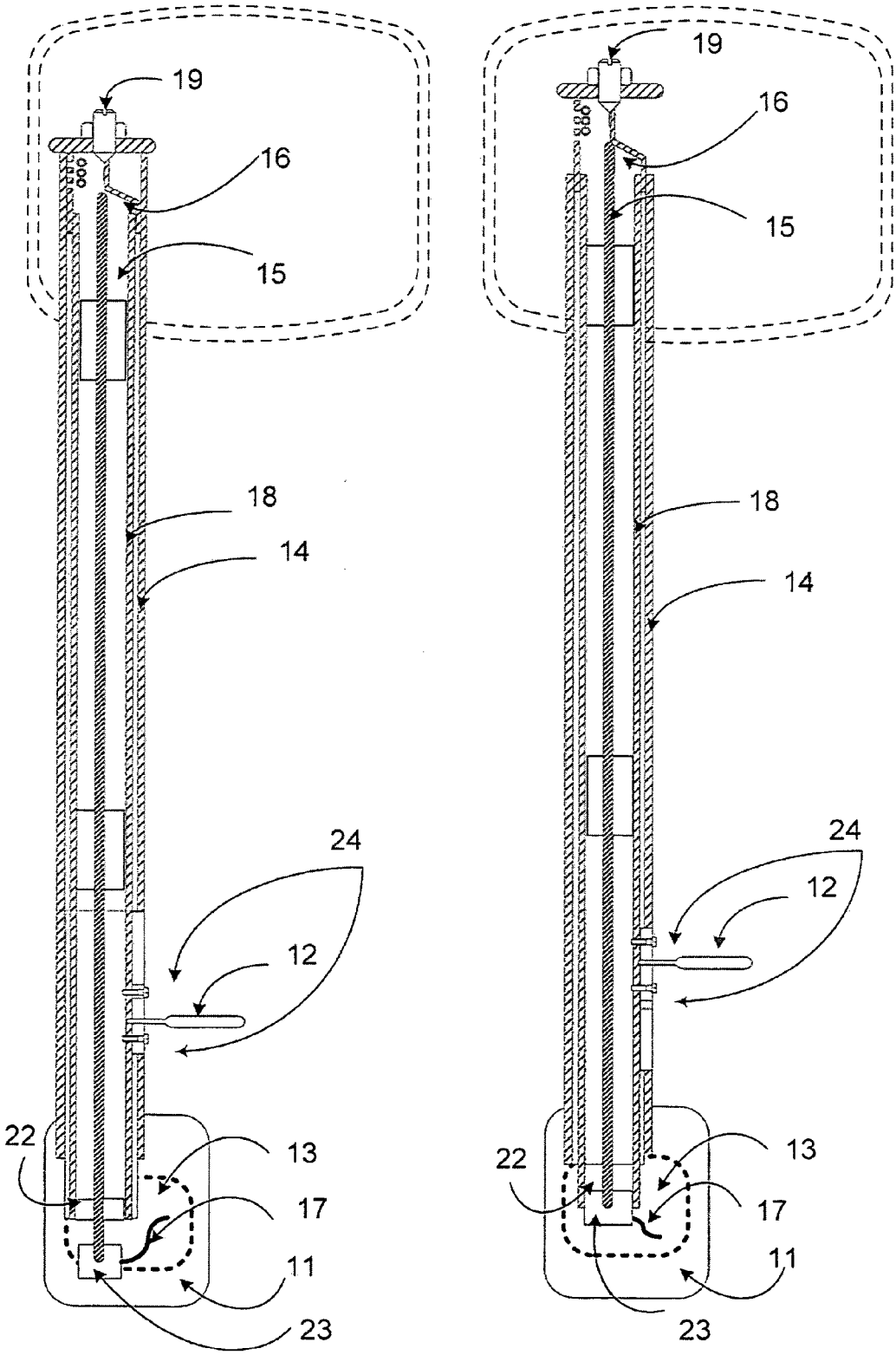
FIGS. 4A and 4B show the inner components of the igniter.

The invention will now be described by reference to the attached Figures.

The present invention relates to a retractable igniter which comprises:

a) an ignition chamber (16);

b) an ignition rod or electrode (15), wrapped in an electrical insulating block (20), an insulating empty space (21) and a bottom insulating terminal (22), and ended in an electric terminal (23);

c) an electrical high voltage assembly (13) inside an insulating box (11) and connected to the electric terminal (23) via an electrical cable (17)

d) an external pilot light pipe (14) encasing an internal pipe (18); and e) an activation lever (12).

The electrode (15) within the ignition chamber (16) is only exposed to the environment during the ignition of a combustible source.

During the time of inactivity of the igniter, the electrode (15) remains safeguarded within the ignition chamber (16).

The retractable igniter is a single device for igniting a combustible source, for example a gas pilot pipe, which does not pertain to the scope of this invention and may be any available in the art.

Preferably, the total aperture of the ignition chamber (16) is approximately 55 mm, but it may be sized only enough for the electrode (15) to be exposed to the combustible environment.

The retractable mechanism of the ignition chamber (16) can be either manual or automated. The internal pipe (18) is displaced inside the external pipe (14) by sliding. This displacement towards the ignition chamber (16) is conducted by the activation lever (12), at the time of ignition.

After ignition of the combustible source, the ignition chamber (16) is retracted again, remaining closed far from the combustible source.

While the ignition chamber (16) is in the retracted position, the electrode (15) remains inside of the external pipe (14) and the insulating box (11), which protect it from humidity during the blow down, from high temperatures, and from the grime coming mainly from combustible oil. Preferably the igniter is powered at 110 or 220 VCA and ignition voltage is of about 14 KV, 40 mA rms.

The internal pipe (18) is inserted into the external pipe (14) and is displaced axially. The displacement is limited by the activation lever (12).

The two pipes (18, 14) are centralized axially by means of screw (24) in such a way as to provide a clearance of 1.6 mm axially along them and limiting the displacement towards the ignition chamber (16) by the activation lever (12).

The ignition chamber (16) contains an adjustable screw nut (19) made of stainless steel including the high voltage electric ignition tip (17) of 20 KV.

The activation lever (12), may be made of carbon steel; the isolating box (11) made of aluminum; the pilot light gas pipe (14) made of carbon steel; the electrode (15) made of steel, with the ignition tip made of nickel/chrome.

The invention claimed is:

1. A retractable igniter for igniting a combustible source, comprising:

a) an ignition chamber, retractable, upper ending an internal pipe with an aperture sized to be exposed to a combustible environment at a time of igniting the combustible source;

b) an electrode, surrounded by an insulating empty space, wrapped in an electrical insulating block, with a bottom insulating terminal, and ended in an electric terminal;

c) an electrical high voltage assembly, inside an insulating box and connected to the electric terminal via an electric cable;

d) an internal pipe, encasing the electrode for displacement at the time of igniting said combustible source;

e) an external pipe, encasing the internal pipe for protecting the internal pipe; and f) an activation lever, limiting the displacement of the internal pipe, for exposing the electrode within the ignition chamber at the time of igniting said combustible source.

2. A retractable igniter according to claim 1, wherein the activation lever is operated manually.

3. A retractable igniter according to claim 1, wherein the activation lever is operated automatically.

4. A retractable igniter according to claim 1, wherein the ignition voltage is of about 14 KV, 40 mA rms.

5. A retractable igniter according to claim 1, wherein the internal and the external pipe are centralized by means of screws that provide the insulating empty space.

6. A retractable igniter according to claim 1, wherein the ignition chamber contains an adjustable screw nut including a high voltage electric ignition tip of 20 KV.

* * * * *